United States Patent [19]

Nye

[11] 3,980,216

[45] Sept. 14, 1976

[54] INSULATED CONTAINER

[76] Inventor: Gary G. Nye, 1057 N. Old Manor, Wichita, Kans. 67208

[22] Filed: Aug. 5, 1974

[21] Appl. No.: 494,876

[52] U.S. Cl. ..... 224/8 R; 220/17; 220/9 F

[51] Int. Cl.[2] ..... A45F 3/00

[58] Field of Search ..... 224/45 R, 45 C, 45 H, 224/45 F, 46 R, 5 N, 5 Q, 5 MA, 7 B, 26 E, 8 R, 25 A, 25 R; 220/306, 354, 22.1, 3.1, 15, 9 F, 14, 23.6, 17, 20; 150/12, 15 R; 190/57

[56] References Cited

UNITED STATES PATENTS

| | | | |
|---|---|---|---|
| 1,031,821 | 7/1912 | Schwarzenbach | 224/8 R |
| 1,397,161 | 11/1921 | Clemetson | 224/8 R |
| 2,792,980 | 5/1957 | Brown | 224/8 R |
| 2,860,396 | 11/1958 | Reiter | 150/12 |
| 3,198,300 | 8/1965 | Tuttle | 224/46 R |
| 3,225,983 | 12/1965 | Majka | 220/9 F |
| 3,491,913 | 1/1970 | Girandet et al. | 220/9 F |
| 3,516,523 | 6/1970 | Pemberton, Jr. | 190/57 |
| 3,549,064 | 12/1970 | Wilson | 224/8 R |
| 3,556,339 | 1/1971 | Lind | 220/306 |
| 3,699,612 | 10/1972 | Hanley et al. | 190/57 |
| 3,805,018 | 4/1974 | Luong et al. | 220/17 |
| 3,836,044 | 9/1974 | Tilp et al. | 220/17 |
| 3,843,016 | 10/1974 | Bornhorst et al. | 220/306 |

FOREIGN PATENTS OR APPLICATIONS

| | | | |
|---|---|---|---|
| 217,098 | 9/1940 | Sweden | 224/8 R |

*Primary Examiner*—Robert J. Spar
*Assistant Examiner*—Kenneth Noland
*Attorney, Agent, or Firm*—John H. Widdowson

[57] ABSTRACT

An insulated container in use is carried on a person's back by carrying straps looped around the person's shoulders. It has a bottom with upright sidewalls and endwalls. A top is removably mountable thereon. The container has ribs in the interior corners thereof at the junctures of the sidewalls and the endwalls with such extending upward from the bottom to the center portion. A shelf is removably mountable on the ends of the ribs. The straps are secured to the container and formed in separate loops on opposite sides of one of the sidewalls.

3 Claims, 6 Drawing Figures

INSULATED CONTAINER

BACKGROUND OF THE INVENTION

This invention is related to insulated containers of the type which can be carried on a person's back.

Many insulated containers are known in the prior art for use in storing or transporting heated or cooled materials, however, these containers are not constructed or designed to be carried on a person's back. Most prior art containers are constructed in a generally elongated rectangular form with the normally horizontally disposed dimension being the longer and they are provided with a carrying strap, handle or the like connected between the ends of the container looping over its top so that a person can carry the container much like a suitcase. Some prior art insulated containers are provided with a tray that can be mounted in the upper portion thereof closely adjacent to the top or lid and used for supporting some cooling material such as ice or the like. In these containers the tray has a flange or the like on its perimeter which is engaged with a recessed portion in the upper portion of the container's sidewalls to hold it in place or in the alternative the tray is constructed with a clip-like structure that is engaged over the sidewalls with the top resting on the clip. The known prior art insulated containers are not particularly well adapted for carrying on a person's back, first, due to the structure of the containers and second, due to the carrying straps or the like that are usually provided on the container. No insulated container is known in the prior art which is constructed and adapted to be carried on a person's back by straps looped around the person's shoulders.

SUMMARY OF THE INVENTION

In a preferred specific embodiment an insulated container structure includes a housing having a bottom with integrally formed upright sidewalls and endwalls forming a cavity therebetween, and a top removably mountable on the housing with the housing having rib members in its interior corners to support a removably mountable shelf. The insulated container has a carrying strap assembly having a pair of carrying straps formed in separate loops mounted on opposed sides of one sidewall so the straps can be looped around a person's shoulders for carrying the container on the person's back. The housing has the bottom, the sidewalls and the endwalls preferably integrally formed of a plastic material. The top of the housing is preferably forcibly mountable thereon and removable therefrom. The insulated container has a rectangular cross section with the normally vertically disposed sides thereof being elongated. A removable shelf is provided in the mid-portion of the housing separating the cavity into an upper portion and a lower portion. The shelf is reversible and can be mounted in either of two positions to change the relative sizes of the upper and lower cavity portions. In an embodiment, (1), of the insulated container the carrying straps are attached to the sidewall by individual mounts for the ends of the straps. In another embodiment, (2), of the insulated container the carrying strap assembly has a pair of circumferential straps encircling the container's sidewalls and endwalls and a pair of support straps secured to the circumferential straps passing under the container's bottom and having the carrying straps secured to the circumferential straps and the support straps at their junctures on one of the sidewalls.

One object of this invention is to provide an insulated container structure overcoming the aforementioned disadvantages of the prior art devices.

Still one other object of this invention is to provide an insulated container structure having a housing with an integrally formed bottom, sidewalls and endwalls, having a removably mountable top and having carrying straps which may be looped around a person's shoulders for carrying the insulated container on the person's back.

Still another object of this invention is to provide an insulated container structure that has a removable shelf mountable in a mid-portion of its cavity. The shelf is reversible in that it can be mounted in one position providing a larger cavity in the lower portion of the container than the upper portion and so it can be mounted in a second position to provide a larger cavity in the upper portion of the container than in the bottom portion.

Yet another object of this invention is to provide an insulated container that in an embodiment has a carrying strap assembly with a pair of carrying straps mounted on one side of the container or the carrying straps are attached to integrally formed mounts on the container's sidewall.

Yet another object of this invention is to provide an insulated container structure in an embodiment which has a carrying strap assembly with a plurality of straps encircling the container's sidewalls and passing below the container with a pair of carrying straps formed in loops on one of the container's sidewalls so the strap assembly enables the container to be easily carried on a person's back with the straps looped around a person's shoulders.

Various other objects, advantages, and features of the invention will become apparent to those skilled in the art from the following discussion, taken in conjunction with the accompanying drawings, in which:

Figure 1:
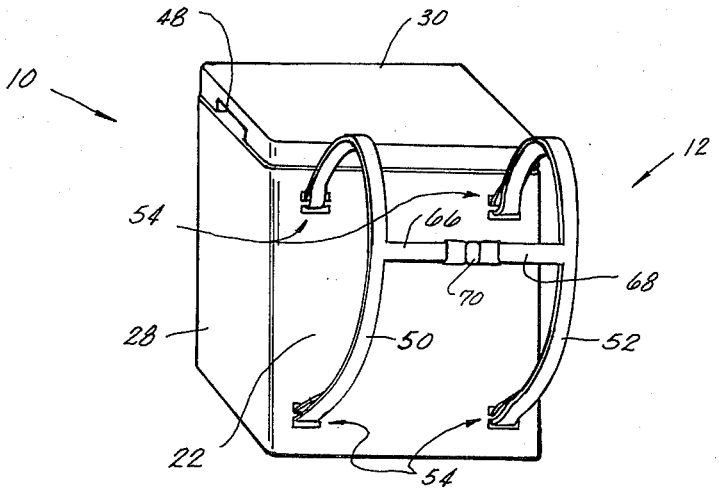
FIG. 1 is a perspective view of an embodiment of the insulated container taken from the side having the carrying strap assembly. The carrying straps in this embodiment are individually mounted on a sidewall of the container.

The following is a discussion and description of preferred specific embodiments of the insulated container structure of this invention, such being made with reference to the drawings, whereupon the same reference numerals are used to indicate the same or similar parts and/or structure. It is to be understood that such discussion and description is not to unduly limit the scope of the invention.

DESCRIPTION OF PREFERRED EMBODIMENTS

Figure 2:
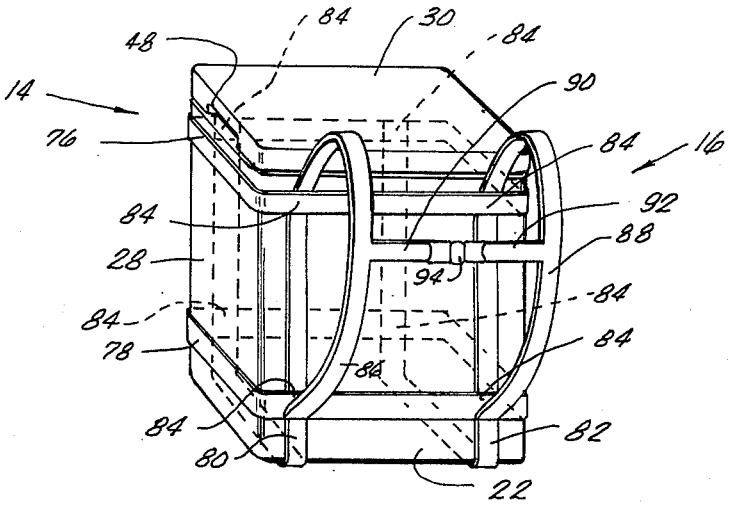
FIG. 2 is a perspective view of another embodiment of the insulated container taken from the side having the looped straps. Dashed lines show the several straps of the carrying strap assembly in their positions on the hidden portions of the container.

Referring to the drawings in detail and in particular to FIGS. 1 and 2. FIG. 1 shows an embodiment, (1), of the insulated container of this invention with such indicated generally at 10. This embodiment, (1), of the insulated container has a carrying strap assembly 12 on one sidewall of the container with the straps mounted directly with the container's sidewall. FIG. 2 shows another embodiment, (2), of the insulated container of this invention with such indicated generally at 14. This embodiment, (2), of the insulated container has a carrying strap assembly indicated generally at 16 which has a plurality of straps surrounding and passing underneath the container and a pair of straps formed in loops extending from one sidewall of the container. In both of the herein described embodiments, (1 and 2), of the insulated container of this invention the container includes a housing constructed of an imperforate material having good thermal insulating properties. The housing has a bottom with integrally formed upright sidewalls and endwalls and has a removable top. Also, the interior or cavity of the housing is provided with a shelf that separates the cavity and which can be mounted in alternate positions in the cavity.

Figure 3:
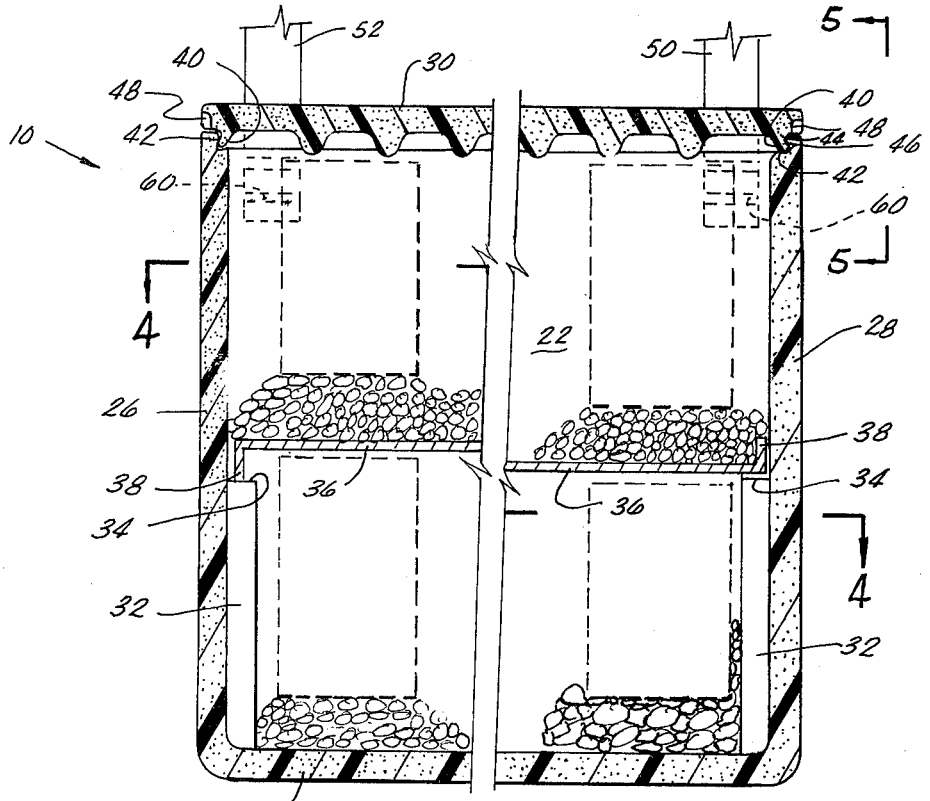
FIG. 3 is a sectional elevation view of an embodiment of the insulated container with the view taken through a mid-portion of the endwalls and the direction of the carrying strap assembly. Dashed lines show the carrying strap mounts and canned articles stored in the container. The view is separated in its center portion with the left side thereof showing the shelf mounted in one position and the right side thereof showing the shelf mounted in an alternate position.

The first embodiment, (1), is shown in FIGS. 1 and 3–6. The housing of the container 10 has a bottom 20 with integrally formed sidewalls 22 and 24 and endwalls 26 and 28. A cavity is formed between the sidewalls 22 and 24 and the endwalls 26 and 28. A top 30 is removably mountable with the open end portion of the sidewalls and the endwalls. Preferably, the housing is constructed with a rectangular cross section elongated in the normally vertical and transverse directions substantially as shown in the drawings. Ribs indicated at 32 are integrally formed in the interior corners of the housing at the junctures of the sidewalls and the endwalls. Each of the ribs 32 extend upward from the bottom 20 with the upper end of each rib indicated at 34 and terminating in a center portion of the cavity. Preferably, the upper ends 34 of the ribs 32 terminate at a point slightly below the center of the cavity as shown in FIG. 3.

A shelf is provided which is mountable in the cavity of the container to support articles in the container. The shelf has a flat imperforate center portion with end members 38 on its opposite ends. The center portion 36 of the shelf is preferably rectangular as shown. The end members 38 extend substantially perpendicular to the center portion 36 from its opposite ends and on the same side. Preferably, the end members 38 are integrally formed with the center portion 36 of the shelf. FIG. 3 shows the shelf mounted in the cavity of the container. The left side of FIG. 3 shows the shelf mounted in the cavity in the position where the end members 38 contact the upper ends 34 of the ribs 32. The right side of FIG. 3 shows the shelf mounted in the cavity in an alternate position where the end members 38 do not contact the upper ends 34 of the ribs 32. In the alternate position the surface of the shelf's center portion 36 which is opposite to the end members 38 rest on the upper ends 34 of the ribs 32. When the shelf is placed in the cavity of the container the cavity is divided into two portions, an upper portion and a lower portion. When the shelf is positioned as shown in the left side of FIG. 3 the lower cavity portion is the larger. When the shelf is positioned as shown in the right side of FIG. 3 the upper portion cavity is the larger.

The top 30 is mountable with the open end of the container's sidewalls and endwalls by a tongue end groove type mount. The top 30 has a tongue 40 on what is its bottom portion that is engagable with a groove 40 in the end portion of the container's sidewalls 22 and 24 and endwalls 26 and 28. The tongue 40 originates at a point inside the perimeter of the top 30 on its bottom side and extends outward therefrom so the extended portion of the tongue is in angular relation to a plane through the top 30. Preferably the tongue 40 is constructed substantially as shown in FIG. 3. The groove 42 is formed in the inside portion of the end portion of the container's sidewalls and endwalls with the groove opening to the open end of the sidewalls and the endwalls. Preferably the groove 42 is constructed substantially as shown in FIG. 3. The groove 42 has a recessed portion at the end of the sidewalls and the endwalls and an additionally recessed portion 46 spaced slightly inward from the end of the sidewalls and the endwalls. The additionally recessed portion 46 of the groove 42 receives the top or extreme outer end of the tongue 40 when the top 30 is mounted on the housing. FIG. 3 shows the top 30 mounted on the housing with the tongue 40 engaged in the groove 42. To mount the top 30 on the housing it is placed on the open end of the housing with the tongue 40 resting on the open end of the groove 42 then it is pushed toward the bottom 20 by finger pressure so the tongue 40 is engaged in the groove 42 to the position shown in FIG. 3. The tongue 40 and groove 42 can be constructed such that only a relatively small amount of force is needed to engage them and a larger amount of force is needed to disengage them. The top 30 has recessed portions 48 in its ends to provide a hand hold or a place to easily grasp the top for removing it from the sidewalls and endwalls of the container. With the tongue and grove mounting for the top constructed as shown and described, the top is forcibly mountable on the housing of the insulated container and likewise it is forcibly removable. The tongue and groove mounting for the top provides for sealing of the cavity. With the tongue and groove mounting for the top 30 constructed as discussed no straps, clips, or the like are required to secure the top in place on the housing.

Figure 6:
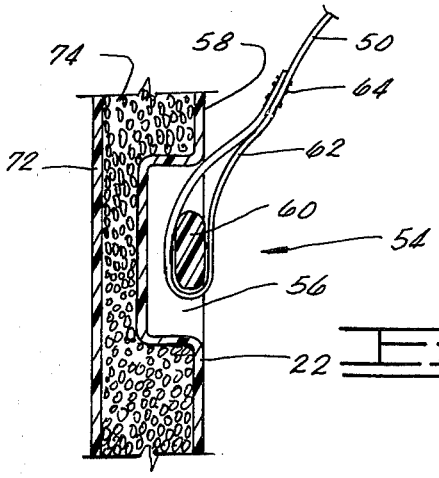
FIG. 6 is a sectional view of a portion of the sidewall portion of the embodiment of the insulated container having the carrying straps mounted therewith. A portion of a carrying strap is shown looped around a bar in the recessed portion of the carrying strap mount.

The carrying strap assembly 12 has a pair of straps 50 and 52 mounted with the container's sidewall 22 as shown in FIG. 1 forming loops. The straps 50 and 52 are mounted with the container's sidewall 22 at mounts 54 that are formed in the sidewall 22. FIG. 6 shows in detail one of the mounts 54 and a strap. The mount shown in FIG. 6 has a recessed portion 56 in what is the outer surface 58 of the sidewall 22 with a bar member 60 across the center portion of the recessed portion 56. The bar member 60 is transverse to the elongated direction of the sidewall 22. The strap 50 shown in FIG.

6 is representative of the ends of both straps and the mounts 54. The strap 50 has a loop 62 in its end portion which is wrapped around the bar 60. The loop 62 is the end portion of the strap which is secured at a seam 64. It is to be noted that the strap 50 can be looped around the bar and secured with itself by a suitable fastening means such as a snap, a buckle, a slide fastener or the like. The straps 50 and 52 have connecting straps 66 and 68 respectively joined by a fastener 70. The connecting straps 66 and 68 are in use connected across the user's chest to prevent the carrying straps 50 and 52 from sliding outward on the person's shoulders as the container 10 is being carried. The fastener 70 can be any suitable fastener, preferably a quick disconnect type.

Figure 4:
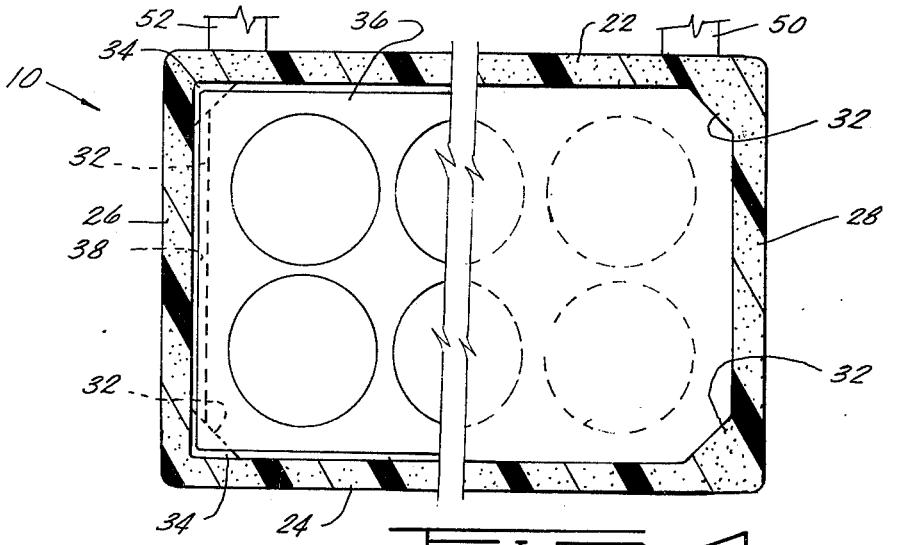
FIG. 4 is a sectional view of the insulated container taken on line 4—4 of FIG. 3 and having dashed lines indicating canned articles stored in the container.
Figure 5:
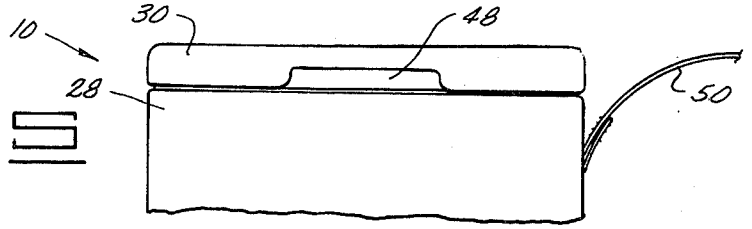
FIG. 5 is an elevation view of the upper portion of the insulated container. This view is taken from the position indicated by line 5—5 in FIG. 3.

It is to be noted that the wall structure shown in FIG. 6 is slightly different than that shown in FIGS. 3 and 4. The container of this invention can be constructed with the wall structure as shown in FIG. 6 if desired. This insulated wall is constructed with an outer member, an inner member 72 and an interior filler 74. In this construction the walls of the housing would be constructed with an outer wall member and an inner wall member in separate pieces and then they would be joined with a wall filler material being inserted. The wall structure shown in FIGS. 3 and 4 is a single component wall structure which can be produced by a molding process. Preferably the wall structure shown in FIGS. 3 and 4 has a foamic plastic material composition where the material is, for example, polyethylene. The housing can be constructed by molding techniques wherein a foaming agent is used in a plastic material, such as polyethylene, to produce a wall that has a substantially smooth or closed cell appearance on its exterior surfaces and an open cellular or foamed interior.

FIG. 2 shows the second embodiment, (2), of the insulated container of this invention. The housing of this embodiment, (2), is substantially the same as that described above in conjunction with the first embodiment, (1), of this invention with the exception that it does not have the mountings 42 for the carrying strap assembly. For clarity the housing shown in FIG. 2 is given the same reference numerals as the housing in the first embodiment, (1). The housing in this embodiment has the same wall construction, removable top, and shelf as described above. The carrying strap assembly 16 includes a pair of circumferential straps 76 and 78 around the housing sidewalls and endwalls on the upper portion thereof and the lower portion thereof respectively. The carrying strap assembly 16 additionally includes a pair of support straps 80 and 82 passing over the housing sidewalls and the bottom which are joined with the circumferential straps 76 and 80 at their intersections 84. FIG. 2 clearly shows the carrying strap assembly 16. The carrying strap assembly 16 has a pair of shoulder straps 86 and 88 connected with the support straps and circumferential straps at the intersections of the straps on the housing sidewall 22. The shoulder straps 86 and 88 are formed in loops connecting the intersections of the straps on the side of the container as shown in FIG. 2. The shoulder straps 86 and 88 have connecting straps 90 and 92 respectively which are connectable by a fastener 94. The connecting straps 90 and 92 are positioned in a center portion of the loop of the shoulder straps 86 and 88 so that in use the connecting straps 90 and 92 will pass across the chest of a person who has the container 14 on their back. It is to be noted that the shoulder straps 86 and 88 and connecting straps 90 and 92 can have buckles, slide fasteners, snaps or the like to make them adjustable lengthwise.

Preferably, the straps of the carrying strap assembly 16 are secured together so the container housing can be slipped into the harness-like carrying strap assembly 16 and retained therein in a snug fit. The circumferential straps 76 and 78 and shoulder straps 86 and 88 can be constructed of a woven material and provided with a tightening apparatus to insure a snug fit around the sidewalls and endwalls of the container housing to retain the carrying strap assembly 16 in place thereon. The circumferential straps 76 and 78 can be constructed of a shrinkable material or a thermosetting material to provide a snug fit on the housing if desired.

In use, both embodiments of the insulated container structure disclosed herein can be used similarly. Both of the containers are carried on a person's back with the shoulder straps looped around the person's shoulders. The shoulder strap connecting straps are joined to prevent the shoulder straps from slipping outward and off of the person's shoulders or to an uncomfortable position. Articles can be arranged in the cavity of the insulated container as illustrated in FIG. 3 and FIG. 4. FIG. 3 illustrates a plurality of cans in the container with crushed ice being positioned below the cans to illustrate how canned goods can be carried in the insulated container of this invention. The insulated container is preferably constructed with dimensions such that a small quantity of ice can be placed in the bottom of the container and on the shelf and the container will accommodate large and small beverage cans. More particularly the container cavity and shelf are proportioned such that tall cans containing approximately 16 fluid ounces can be positioned upright in the large portion of the cavity and at the same time smaller beverage cans containing approximately 12 fluid ounces can be positioned upright in the small cavity portion. It is to be noted that 6 nominal size beverage cans can be placed in a layer in each portion of the cavity of the container. The insulated container can be used to carry 12 nominal size beverage cans if desired with 6 cans carried in each portion of the cavity.

In the manufacture of the insulated container structure of this invention it is obvious that either embodiment of such can be easily constructed by techniques used in the art of manufacturing plastic articles to achieve the end product. Preferably, the insulated container structure is constructed of a good insulating material such as foamic plastic material. The straps of the carrying strap assembly portion of the insulated container in either embodiment can be constructed of a woven material or an imperforate material depending upon the desire of the user and provided with suitable fixtures for length adjustment.

In the use and operation of the insulated container structure of this invention it is seen that same provides an insulated container which can be easily carried on a person's back and used for the transportation of cooled materials. The container is constructed of a size which will accept a substantial quantity of nominally sized beverage containers or a substantial quantity of other goods. The insulated container of this invention is a particularly useful structure in that it can be carried on a person's back which leaves the hands free. This feature is desirable when the person is involved in activites such as hiking, bicycle riding, etc.

As will become apparent from the foregoing description of the Applicant's insulated container structure, relatively inexpensive and simple means have been provided to present an insulated container structure which can be carried on a person's back. The insulated container structure is economical to manufacture, attractive in appearance and can be used repeatedly to carry a variety of goods in a cooled condition. The insulated container provides a structure which is extremely convenient for bicyclists, hikers, etc. where it is desirable to carry a quantity of refreshments or food stuffs on a trip or excursion.

While the invention has been described in conjunction with preferred specific embodiments thereof, it will be understood that this description is intended to illustrate and not to limit the scope of the invention, which is defined by the following claims.

I claim:

1. A container, comprising, a. a housing having a bottom with integral upright sidewalls and endwalls to form a cavity therebetween said housing being open on one end portion thereof, b. a top removably mounted with said sidewalls and endwalls on said open end portion by a means to mount same, c. said housing having rib members in interior corners thereof at junctures of said sidewalls and said endwalls, said rib members extending upward from said bottom and having their upper ends in a center portion of said housing.

d. a shelf removably mountable in said container, said shelf when mounted in said container resting on the upper ends of said rib members, and e. a carrying strap means mounted on said housing having a pair of carrying straps formed in separate loops on opposed sides of one of said sidewalls, said carrying strap means having strap mounts integrally formed in an outside portion of one of said sidewalls in a spaced relation at corner portions of same said sidewall, said strap mounts each have a recessed portion in said sidewall and a bar portion in a spaced relation in said recessed portion and say carrying strap each have their opposite ends secured to said bars on one side portion of said container, f. said shelf has a substantially flat center portion with raised portions oppositely extending perpendicularly from opposed faces of said center portion on opposed end portions of said center portion, and said shelf being alternately mountable in said container in one position with one of said raised portion resting on said upper end of one of said rib members or in a second position with the face of said shelf opposite to said first named raised portion thereon resting on said upper end of said one of said rib members;

said container is constructed and adapted to in use be carried by said carrying strap means on a person's back with said loops being around the person's shoulders.

2. The container of claim 1, wherein, said housing and said top are formed of a foamic plastic material.

3. The container of claim 1, wherein:

a. said means to mount said top has a groove portion formed in said sidewalls and said endwalls at said open end portion with said groove opening into said cavity and having a tongue portion on a lower portion of said top, said tongue portion being forcibly engagable with said groove portion to in use secure said top on said housing, and b. said container has a rectangular cross section with elongated sides.

* * * * *